US008319696B2

(12) United States Patent
Clayton et al.

(10) Patent No.: US 8,319,696 B2
(45) Date of Patent: Nov. 27, 2012

(54) POSITIONING MECHANISM FOR A SPHERICAL OBJECT

(75) Inventors: William R. Clayton, Madison, AL (US); Paul A. Gierow, Madison, AL (US)

(73) Assignee: GATR Technologies, Huntsville, AL (US)

( * ) Notice: Subject to any disclaimer, the term of this patent is extended or adjusted under 35 U.S.C. 154(b) by 1287 days.

(21) Appl. No.: 11/961,257

(22) Filed: Dec. 20, 2007

(65) Prior Publication Data

US 2009/0158878 A1 Jun. 25, 2009

(51) Int. Cl.
*H01Q 3/08* (2006.01)

(52) U.S. Cl. ..... 343/765; 343/766; 74/490.07; 474/4

(58) Field of Classification Search ..... 343/766, 343/765, 763, 882; 474/4; 74/490.07, 665 F, 74/665 G, 665 GE, 89.23
See application file for complete search history.

(56) References Cited

U.S. PATENT DOCUMENTS

| | | | | |
|---|---|---|---|---|
| 1,393,693 | A * | 10/1921 | Otti | 474/4 |
| 4,672,389 | A * | 6/1987 | Ulry | 343/915 |
| 5,404,868 | A | 4/1995 | Sankrithi | |
| 6,167,924 | B1 | 1/2001 | Buckley et al. | |
| 6,300,893 | B1 | 10/2001 | Schaff et al. | |
| 6,650,304 | B2 | 11/2003 | Lee et al. | |
| 6,963,315 | B2 * | 11/2005 | Gierow et al. | 343/872 |

* cited by examiner

*Primary Examiner* — William C Joyce
*Assistant Examiner* — Terence Boes
(74) *Attorney, Agent, or Firm* — George P. Kobler; Lanier Ford Shaver & Payne

(57) ABSTRACT

A positioning system for a spherical object which adjusts orientation thereof in azimuth and elevation comprising first and second drive rods threadably engaged with respective first and second brackets secured to the surfaces of opposing left and right hemispheres the object The first and second drive rods include a first coupling configured for imparting co-rotation to the drive rods and a second coupling configured for imparting counter-rotation to the drive rods, and a clutch for selecting operation of either coupling.

2 Claims, 2 Drawing Sheets

POSITIONING MECHANISM FOR A SPHERICAL OBJECT

The present invention is described with reference to the accompanying drawings. In the drawings, like reference numbers indicate identical or functionally similar elements.

DETAILED DESCRIPTION

The various embodiments of the present invention and their advantages are best understood by referring to FIGS. 1 through 4 of the drawings. The elements of the drawings are not necessarily to scale, emphasis instead being placed upon clearly illustrating the principles of the invention. Throughout the drawings, like numerals are used for like and corresponding parts of the various drawings.

The drawings represent and illustrate examples of the various embodiments of the invention, and not a limitation thereof It will be apparent to those skilled in the art that various modifications and variations can be made in the present inventions without departing from the scope and spirit of the invention as described herein. For instance, features illustrated or described as part of one embodiment can be included in another embodiment to yield a still further embodiment. Moreover, variations in selection of materials and/or characteristics may be practiced to satisfy particular desired user criteria. Thus, it is intended that the present invention covers such modifications as come within the scope of the features and their equivalents.

Furthermore, reference in the specification to "an embodiment," "one embodiment," "various embodiments," or any variant thereof means that a particular feature or aspect of the invention described in conjunction with the particular embodiment is included in at least one embodiment of the present invention. Thus, the appearance of the phrases "in one embodiment," "in another embodiment," or variations thereof in various places throughout the specification are not necessarily all referring to its respective embodiment.

The positioning apparatus described herein is generally contemplated for use with an inflatable, portable antenna apparatus. For an example of such inflatable antenna apparatuses, please see U.S. Pat. No. 6,963,315, to Gierow, et al, which is incorporated herein by reference. An inflatable antenna apparatus as contemplated herein is essentially a two-chamber, gas-filled sphere where a partition between the two chambers is maintained the shape of a parabolic dish, or lenticular. The partition reflects energy to or from a feed horn assembly mounted in the surface of the sphere. The parabolic shape of the reflector may be maintained by having higher air pressure in the chamber on the reflecting side of the partition, than in the chamber on the opposing side.

Figure 1:
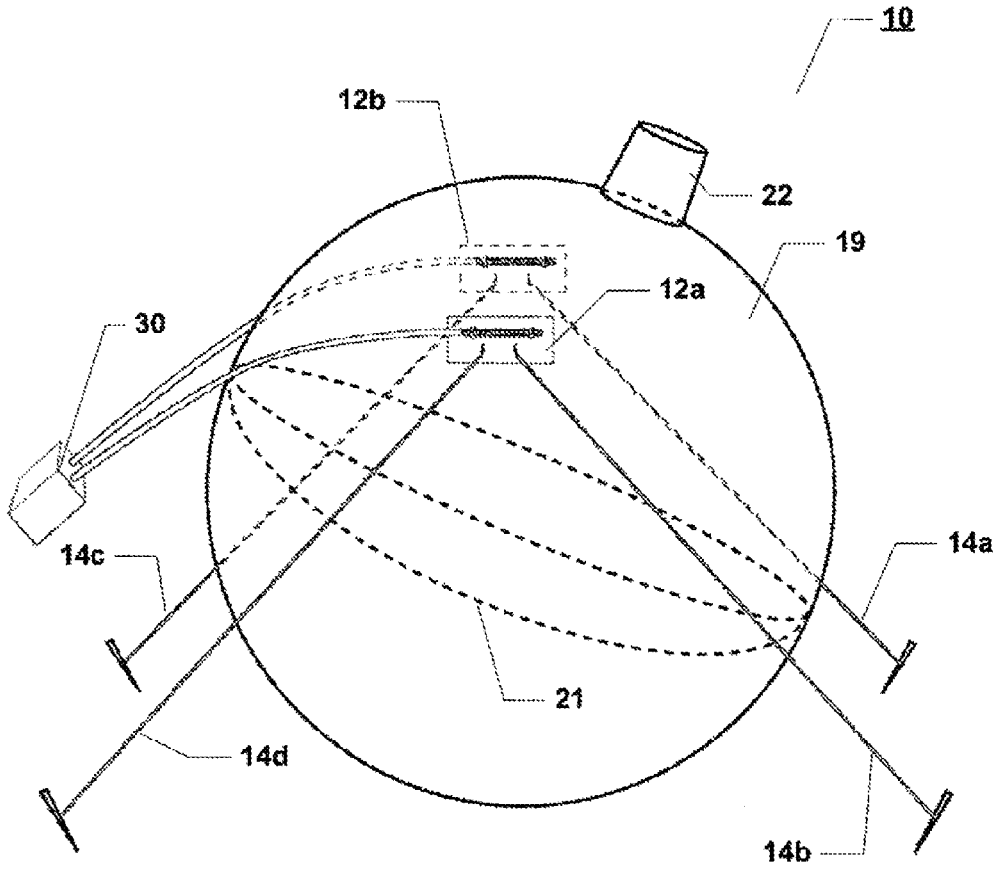
FIG. 1 depicts a spherical antenna which employs an exemplary positioning system according to an embodiment of the present invention.

An exemplary positioning system 10 for an inflatable antenna 19 is shown in FIG. 1. The antenna 19 includes a spherical outer skin 20 and membrane 21 in the interior of the sphere roughly disposed at the interior equator. When inflated, the antenna 19 is comprised of an upper and lower chamber the upper chamber having a slightly greater air pressure so as to maintain the membrane in a general parabolic shape. A feed horn 22 is positioned on the outside surface of the sphere and is located roughly at the focal point of the parabola created by the membrane 21. The membrane 21 is formed having an electromagnetic reflective surface oriented toward the feed horn 22. Consequently, the inflatable antenna functions as parabolic antennas currently known in the art.

The positioning system 10 includes a plurality of anchor lines 14*a-d*, the uppermost ends of which engage a bracket member 12*a, b* that is attached to the surface of the sphere, on the upper hemisphere and disposed laterally from the feed horn 22. As can be better understood with reference to FIG. 2, each bracket member 12*a, b* includes one or more eyelets 15*a, b* that are threadably engaged by a drive rod 17*a, b*. The drive rod 17*a, b* includes a threaded end portion 25 that is received by the eyelets 15*a, b*.

Figure 4:
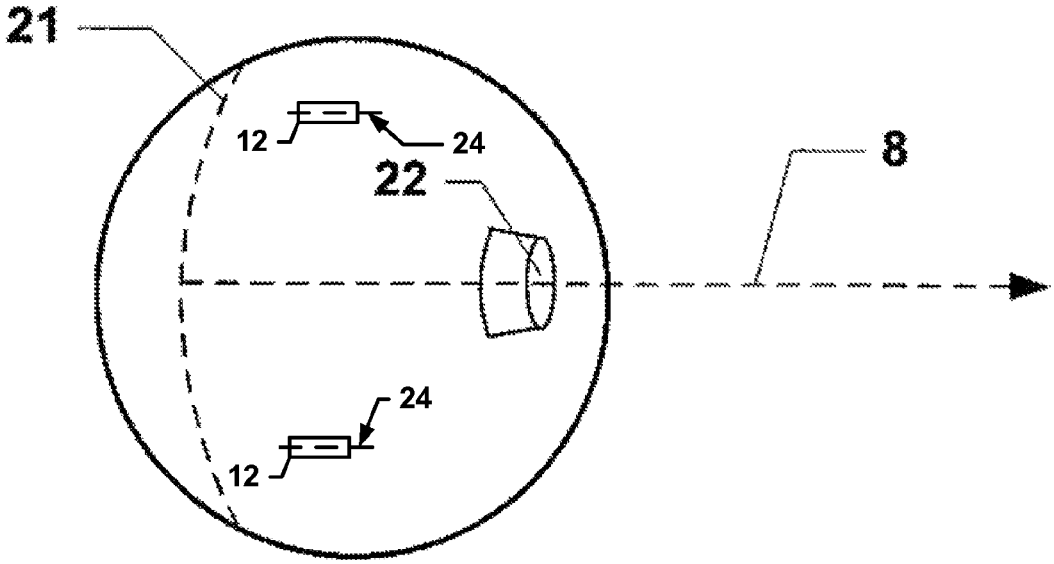
FIG. 4 is a top plan view of a spherical antenna housing that illustrates the pointing of an apparatus in accordance with the concepts of the present invention.
Figure 2:
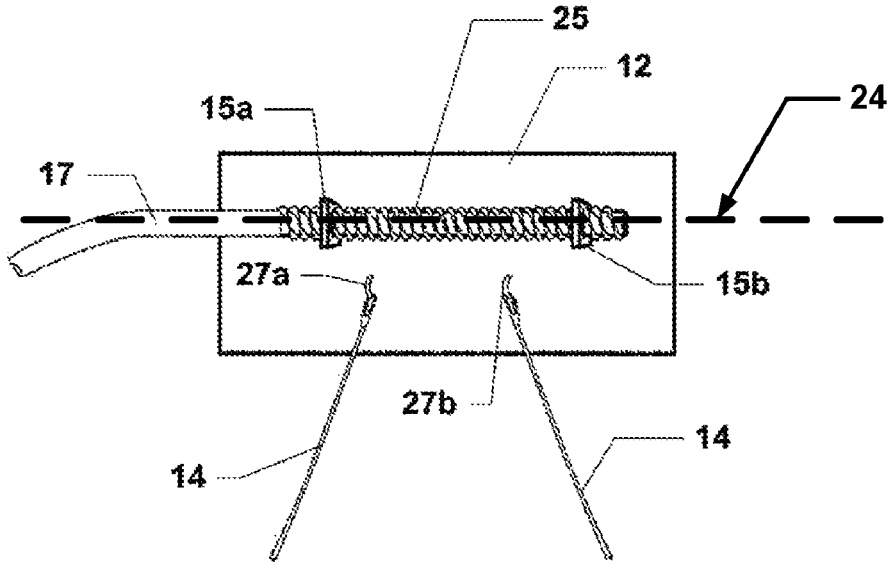
FIG. 2 illustrates an exemplary bracket for use in the positioning system.

Bracket member 12 comprises at least an axis 24. Eyelets 15*a,b* are disposed along the axis 24 of the bracket member 12, and the bracket is oriented on the surface of the antenna such that the axis 24 is generally parallel with the surface on which the antenna sits and generally in the direction in which the feed horn 22 is oriented for operation, which is known in this disclosure as a "heading" (FIG. 4 at 8).

It should be noted that the Figures depict a configuration in which anchor lines 14*a-d* are separate members and each engage bracket 12 by separate connection of their respective ends to anchor eyelets 27*a, b*. Anchoring could be achieved with a single anchor line passing through one or more anchoring eyelets 27*a,b*.

Figure 3:
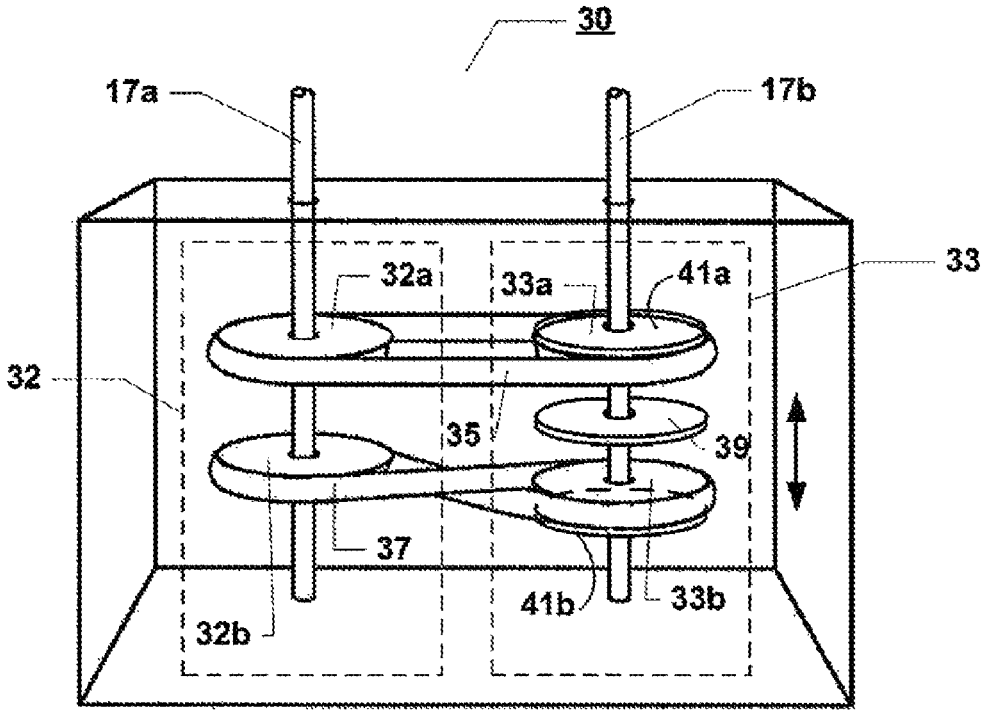
FIG. 3 shows a differential transmission for use in the positioning system.

Drive rod members 17 extend rearwardly from bracket 12 to a differential transmission 30. FIG. 3 presents a more detailed view of differential transmission 30 in which a pair of pulleys 32, 33 are each mounted to drive rods 17*a, b*. First, corresponding pulleys, 32*a*, 33*a*, are mutually engaged with first belt, or band 35 whereby rotation of one pulley causes rotation of the corresponding pulley in the same direction. On the other hand, second corresponding pulleys 32*b*, 33*b* are mutually engaged with second belt 37 which is twisted into a "figure eight," such that rotation of a pulley in one direction imparts rotation in the opposing direction on the corresponding pulley.

The transmission 30 includes a clutch mechanism 39 which permits the selection of mutually engaged pairs of pulleys 32, 33 mounted to either drive rod 17. In this embodiment, the pulleys 32, or 33, on the same drive rod 17 as that on which the clutch 39 is mounted are themselves mounted to the drive rod 17*b* in a manner to allow them to freewheel, i.e., rotate without restriction, about the rod 17*b* when not engaged by the clutch 39. Clutch 39 is configured to be selectively positioned against either the lower surface of the upper pulley 33*a*, or the upper surface of the lower pulley 33*b* to provide a friction surface against the selected surface pulley 33*a, b*, but is mounted to rod 17*b* so that it rotates along with the rotation of the rod 17*b*. Upper and lower disks are fixedly mounted on the rod 17*b* against the respective opposite surface of each pulley 33*a*, 33*b* from the side near the clutch 39 and rotate with the rotation of the rod 17*b*, also providing friction surface against the respective opposing pulley surfaces.

In operation, the drive rods 17 are rotated by any suitable means for imparting rotation. The threaded ends thereof are engaged with eyelets 15 on the brackets 12, and rotation clockwise or counter-clockwise causes the bracket 12 to be drawn back or pushed forward. If the clutch mechanism 39 is positioned against the lower surface of the upper pulley 33*a* forcing it against the upper disk 41*a*. Then rotation of the rod 17*b* imparts rotation to the clutch 39 and upper disk 41*a*, and through friction of the clutch 39 and upper disk 41*a* against the lower and upper surfaces of the upper pulley 33*a*, the upper pulley 33*a* is rotated. Thus, the upper set of pulleys 32*a*, 33*a* are selected, which in this example are coupled by band 35 so that rotation of one rod 17*a* rotates the other rod 17*b* in the same direction, and vice-versa. Therefore, both rods will rotate either clockwise or counter-clockwise. This draws or pushes both brackets 12 which are attached the upper surface of the sphere. Accordingly, the sphere may be rotated in this manner in the vertical plane.

The second set of pulleys 32*b*, 33*b* may be selected by positioning the clutch 39 against the upper surface of the lower pulley 33*b* such that lower pulley 33*b* is compressed against lower disk 41*b*, and rotation of the rod is translated to the pulley through frictional grabbing of the clutch 39 and disk 41*b* against the lower pulley 33*b*. In this example, the lower set of pulleys 32*b*, 33*b* are mutually engaged with a crossed band 37 so that rotation of one rod 17*a* imparts rotation on the other rod 17*b* in the opposite direction. Thus, clockwise rotation of the first rod 17*a* means counter-clockwise rotation of the second rod 17*b*, and vice-versa. In this way, when a rod 17 is rotated in a direction, one bracket 12 is drawn back, and the other bracket is pushed forward. Accordingly, the sphere may be rotated in the horizontal plane so that the feed horn may be pointed to either side of the heading 8.

It will be appreciated by those skilled in the relevant arts that positioning of the clutch 39 may be achieved by any variety of means, including manual, mechanical or electromechanical. It will also be appreciated that in order to achieve the adjustments to the orientation of the spheroidal antenna housing in the vertical plane (elevation), the brackets should be located on the same hemisphere, either upper or lower. Similarly, to achieve adjustments to the orientation of the housing in the horizontal plane (azimuth), the brackets should be located on opposing left and right hemispheres.

As described above and shown in the associated drawings, the present invention comprises positioning system for spherical objects. While particular embodiments of the invention have been described, it will be understood, however, that the invention is not limited thereto, since modifications may be made by those skilled in the art, particularly in light of the foregoing teachings. For example, the roles of the upper and lower pulleys in FIG. 3 may be reversed where the upper pulleys are configured to be counter-rotating and the lower are configured to be co-rotating. Additionally, clutch mechanism 39 may be mounted to either drive rod. It is, therefore contemplated by the following claims to cover any such modifications that incorporate those features or those improvements that embody the spirit and scope of the present invention.

What is claimed is:

1. A positioning system for a generally spheroidal housing for an antenna which is to be controllably adjusted about a desired heading in azimuth and elevation, said system comprising first and second drive rods threadably engaged with respective first and second elongated brackets secured to the surfaces of opposing left and right hemispheres of said spheroidal housing, said first and second drive rods having first and second couplings, said first coupling configured for imparting dependent co-rotation to said drive rods, said second coupling configured for imparting dependent counter-rotation to said drive rods, and a clutch for selecting operation of either said coupling.

2. A positioning apparatus for a spheroid which is desired to be oriented toward a selected heading comprising:

a. first and second elongated brackets members attached to the surface of the spheroid on left and right hemispheres respectively, each bracket having an axis disposed generally parallel with the horizontal plane and generally aligned with a desired heading, each bracket comprising at least one threaded eyelet;

b. first and second drive rods, each drive rod having threaded ends that are each threadably engaged with each said at least one eyelet, and distal ends; and c. a transmission coupled to said distal ends for imparting selective rotation to said first and second drive rods, said transmission having a first pair of mutually engaged pulleys mounted to each of said first and second drive rods respectively such that rotation of one pulley on said first drive rod causes dependent rotation of the engaged pulley and said second drive rod in the same direction, and a second pair of mutually engaged pulleys mounted to each of said first and second drive rods such that rotation of one pulley on said first drive rod causes dependent rotation of the engaged pulley and said second drive rod in the opposite direction, and a clutch for selecting between said first and second mutually engaged pairs.

* * * * *